US006199493B1

(12) United States Patent
Kiss

(10) Patent No.: US 6,199,493 B1
(45) Date of Patent: Mar. 13, 2001

(54) PROCESS FOR STORING HETEROGENEOUS RUBBISH IN AN INERT GAS

(75) Inventor: Gunter H. Kiss, Minusio (CH)

(73) Assignee: Thermoselect AG, Vaduz-FL (DE)

( * ) Notice: Subject to any disclaimer, the term of this patent is extended or adjusted under 35 U.S.C. 154(b) by 0 days.

(21) Appl. No.: 09/262,650

(22) Filed: Mar. 4, 1999

Related U.S. Application Data

(63) Continuation-in-part of application No. 08/693,122, filed as application No. PCT/DE95/00191 on Feb. 15, 1995, now abandoned.

(30) Foreign Application Priority Data

| | | |
|---|---|---|
| Feb. 15, 1994 | (DE) | 44 04 679 |
| Mar. 1, 1994 | (DE) | 44 07 107 |
| Jun. 10, 1994 | (DE) | 44 20 449 |

(51) Int. Cl.[7] ..... F23B 7/00

(52) U.S. Cl. ..... 110/342; 110/346; 110/229; 110/186; 110/219; 48/197 R; 220/908

(58) Field of Search ..... 110/346, 348, 110/342, 341, 185, 186, 188, 189, 218, 219, 223, 229; 48/197 R; 220/88.1, 88.3, 908, 913, DIG. 17, DIG. 20; 141/37; 222/53, 152; 137/455

(56) References Cited

U.S. PATENT DOCUMENTS

| | | | | |
|---|---|---|---|---|
| 1,803,460 | * | 5/1931 | Brooks . | |
| 1,849,932 | * | 3/1932 | Johnson . | |
| 2,551,216 | * | 5/1951 | Martin | 99/235 |
| 2,964,916 | * | 12/1960 | Keeping | 62/48 |
| 3,691,730 | * | 9/1972 | Hickey et al. | 55/166 |
| 3,777,928 | * | 12/1973 | Kober | 220/88 |
| 3,820,687 | * | 6/1974 | Brock | 222/53 |
| 4,384,536 | * | 5/1983 | Biswas | 110/342 |
| 4,934,286 | * | 6/1990 | Fowler | 110/346 |
| 4,958,659 | * | 9/1990 | Dowdall | 137/624 |
| 5,156,290 | * | 10/1992 | Rodrigues | 220/87 |
| 5,282,931 | * | 2/1994 | LeClere et al. | 162/49 |

FOREIGN PATENT DOCUMENTS

4130416 * 10/1992 (DE) .

* cited by examiner

*Primary Examiner*—Ira S. Lazarus
*Assistant Examiner*—Ljiljana V. Ciric
(74) *Attorney, Agent, or Firm*—Howard & Howard

(57) ABSTRACT

The invention concerns a process for the storage of heterogeneous wastes in holding or supply dumps, such as rubbish bunkers or suitable rubbish containers, prior to its removal and subsequent thermal utilization or some other processing technique. By introducing a variable flow of inert gas consisting essentially of nitrogen and carbon dioxide into the rubbish bunker, fires and gas explosions are practically excluded, aerobic decomposition processes are suppressed, and anaerobic decomposition is retarded. Using a variable flow of inert gas also prevents the further formation of dioxins and furans in a subsequent thermal utilization, as well as reliably preventing vermin from attacking the rubbish. By avoiding or at least significantly reducing these disturbances in the bunker zone, disposal safety is significantly increased. Storage of the wastes preferably takes place in an essentially inert atmosphere which is introduced into the rubbish bunker adjacent the bottom so that the inert gas flows upwardly through the rubbish. Storage of the wastes in an inert atmosphere essentially prevents the occurrence of a fire.

10 Claims, 1 Drawing Sheet

PROCESS FOR STORING HETEROGENEOUS RUBBISH IN AN INERT GAS

RELATED APPLICATIONS

This application is a continuation-in-part of application Ser. No. 08/693,122 filed Oct. 16, 1996, and now abandoned, which in turn, is a 371 of PCT/DE95/00191 file Feb. 15, 1995.

BACKGROUND OF THE INVENTION

1. Field of the Invention

The invention concerns a process for the storage of heterogenous rubbish in holding or supply dumps such as rubbish bunkers or suitable rubbish containers before its removal and subsequent thermal utilization or a different processing operation.

2. Description of Related Art

Plants where wastes (such as domestic and special garbage, clearing sludge and industrial scrap) are thermally treated, have rubbish bunkers on the entry side. Relatively large quantities of these heterogeneous waste materials are stored temporarily or as a supply in the rubbish bunkers. These wastes, designated here as a whole using the term "rubbish", are a significant environmental risk due to their very heterogeneous composition and their usual storage quantities in the thousands of tons.

Ignition sources, such as furnace ashes, chemicals and metal parts are brought into the rubbish bunkers uninspected. Aerobic and anaerobic processes also take place in the rubbish bunker, despite the continuous exchange of air, which among other things can cause an increase in temperature to the point of spontaneous combustion. The ignition sources and the aerobic and anaerobic processes which can possibly cause combustion are collectively referred to as "disturbance law."

Rubbish bunkers are therefore a potential danger in the sense of the disturbance law. Disturbances result in considerable and extremely negative effects. Obviously these negative disturbances in the rubbish bunker can lead to other types of disturbances in other areas of the plant with even greater negative effects (J. Look, *TÜV Bayer/Sachsen,* Safety Technology in Rubbish-incineration Plants with a View to the Disturbance Law. Conference on the Thermal Disposal of Wastes and Rubbish, Dec. 9–10, 1993, Cologne).

The significant hazardous materials released by burning are: heavy-metal compounds; acid gases; organic pollutants from the low-temperature carbonization of plastics; and polyhalogenated dibenzodioxins and furans as well as other carcinogenic materials.

The studies from the *TÜV Bayer/Sachsen*(Look), cited above, document the potential qualitative and quantitative hazardous-materials in a manageable form.

The aerobic and anaerobic processes that take place in the rubbish bunker typically cause the temperature near the center of the rubbish pile to rise. Eventually the temperature can rise to the point of spontaneous combustion leading to smoldering fires which spread long unnoticed beneath the surface of the rubbish and are frequently difficult to reach. These smoldering fires in the bunkers of large plants can therefore persist for a long time, possibly several weeks.

The frequency and duration of the rubbish-bunker fires represent not only a considerable ecological risk, but also reduce the availability of the rubbish-incineration plants for other processing purposes and impair the safety of disposal.

Aside from the ecological and technical problems which a rubbish bunker fire brings with it, the economic burden is significant. Besides the interruption of operations and the halt to disposal thus associated with it, the partially burned rubbish, soaked with the fire-extinguishing agent, must be removed from the bunker after the fire has been put out along with all pollutants and disposed of elsewhere. The economic, ecological and technical damages borne by the operator of such plants are inadequately covered by insurance. Insurers find it difficult to estimate the risk of bunker fires, thus the already considerable insurance premiums continue to rise. Another factor which contributes to high insurance premiums is the possibility of litigation resulting from damage caused by the fires.

A further risk arising from the storage of rubbish in holding or supply dumps is represented by the methane buildup resulting from possible decomposition processes. When methane is mixed with air, an ignitable gas mixture is created which can lead to increased danger of explosion.

Measured against the possible expansion of a bunker fire and the dangers involved with the formation of ignitable gas mixtures, a possible attack upon the stored material by pests in the storage area is of course not as dangerous. However, here too, some precautionary measures must be taken.

It was and is therefore the concern of the technical world to recognize bunker fires early, to begin application of appropriate extinguishing means at the earliest possible time and to avoid the formation ignitable gas mixtures by intensive air circulation in the rubbish bunkers. The relevant state of the art has thus far been limited to fighting fires in the rubbish bunker only in the event of a blaze. Special precautionary measures for fire prevention are not available at this point.

Rubbish bunkers in conformity with the existing fire-protection requirements must, among other things, be equipped with fire walls, heat-resistant extraction devices, shutters on vents for smoke and heat, safety units supplied by emergency electric power, fire-monitoring systems and infrared cameras for possible localization of the site of the fire. Because rubbish-bunker fires are as a rule not on the surface, but develop inside the stored rubbish, the necessary technical means for fire fighting are inadequately suitable, despite infrared cameras, for pinpointing the locality of the fire precisely and fighting it efficiently, and are by no means suitable for preventing it before it arises.

SUMMARY OF THE INVENTION

The purpose of the present invention is therefore to create a process in which the fires and gas explosions can be practically prevented during the storage of waste of the type described in bunkers or large containers, aerobic decomposition processes being suppressed and anaerobic decomposition retarded, in which case moreover the formation of dioxins and furans in a subsequent thermal utilization is prevented insofar as possible, and attack of the stored materials by vermin is reliably prevented. By reducing these disturbances in the bunker, the safety of disposal should be reliably increased, and operating costs reduced.

The goal of the invention is achieved by a process for storing heterogeneous rubbish in holding or supply containers, such as rubbish bunkers or suitable rubbish containers, before its removal and subsequent thermal utilization or a different processing operation. The invention is characterized by the storing the wastes in an essentially inert atmosphere secure from fire danger.

DESCRIPTION OF THE PREFERRED EMBODIMENT

Figure 1:
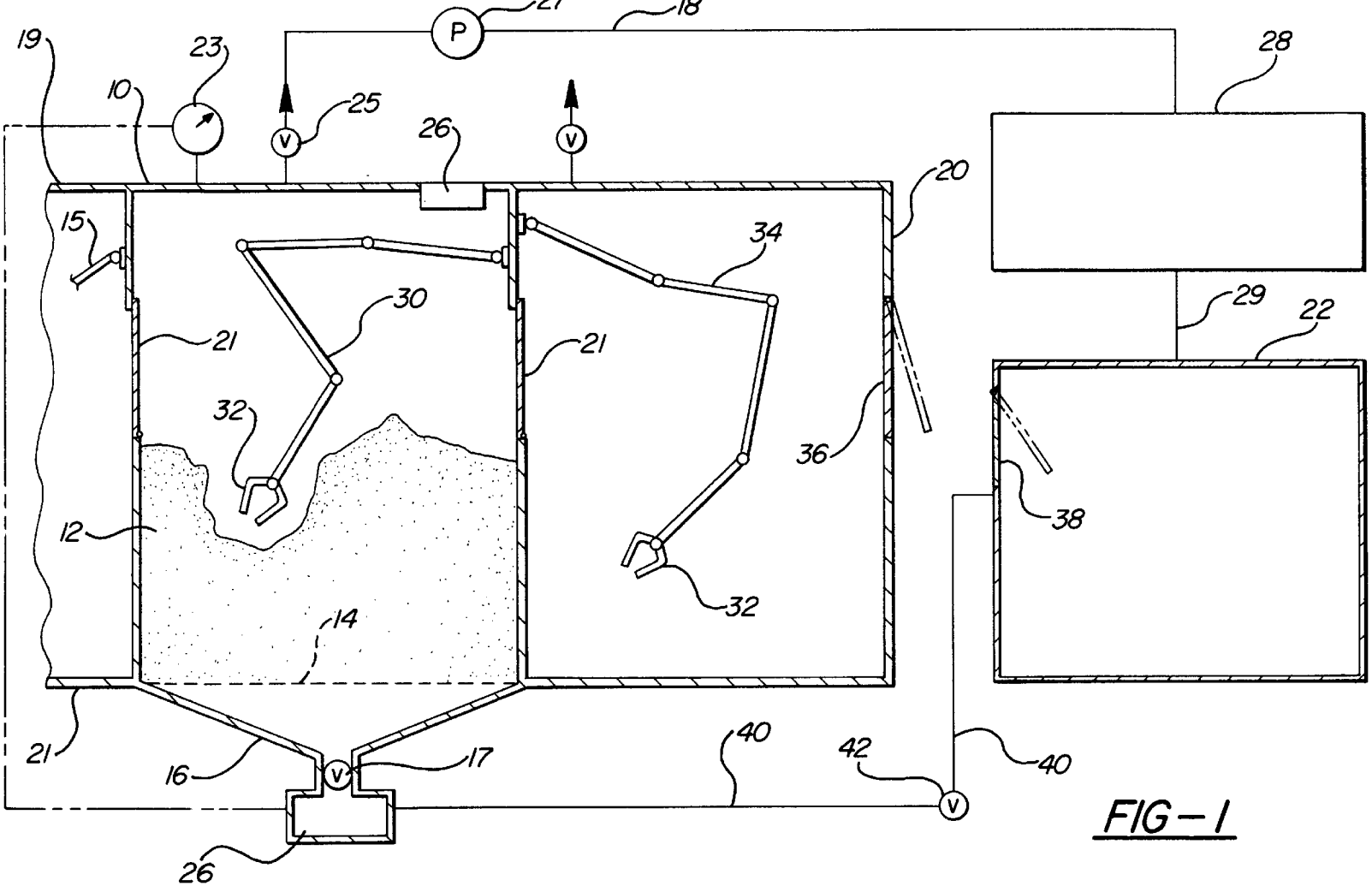
FIG. 1 shows a schematic view of the inventive process.

By virtue of the fact that the storage of the rubbish is implemented in an atmosphere of inert gas, with the inert gas flowing through the rubbish, the oxygen necessary for the formation of fires is absent at each point in time and at each storage location. Externally introduced ignition sources are extinguished, a spontaneous combustion of the rubbish, induced by exothermal decomposition processes, is prevented, aerobic decomposition processes do not take place, and anaerobic decomposition is at least slowed with the presence of nitrogen and/or carbon dioxide. Attack of the stored materials by vermin will also fail to take place in an inert atmosphere.

If the interior pressure of the inert-gas atmosphere in the rubbish bunker diverges from the external pressure, there will thus be no odor pollution in the bunker vicinity due to the slight pressure difference in the bunker. The inert-gas atmosphere can be shut off from the external air by the use of suitable pressure locks which are located adjacent to the rubbish bunker.

Because the inert-gas atmosphere does not permit bunker fires to develop and excludes the formation of ignitable gas mixtures, the currently prescribed frequent changing of the bunker atmosphere becomes superfluous. Thus, when the rubbish bunker containing heterogeneous rubbish in an inert atmosphere is sealed off from external air by the pressure locks, there is no need for replacement of inert gas. Replacement of inert gas is necessary only in the case of the slight loss of inert gas taking place during operation of the loading and discharge locks. It is important for the highest standard of safety that inert gas is passed not only through the bunker, but through the rubbish itself. Arising with this type of operation is the advantage that even the atmospheric oxygen simultaneously introduced in the volume of the rubbish is reliably removed and replaced with inert gas. By arranging the inert-gas feed in the floor zone of the storage bunker, a reliable flow of inert gas through the rubbish can be achieved without difficulty.

The rubbish introduced into the inert atmosphere contains ordinarily only small amounts of oxygen. With subsequent degassing during thermal preparation, which occurs during a later stage of the rubbish treatment process, the formation of organic pollutants, for example dioxins and furans, is largely suppressed.

In the case of known rubbish-treatment processes, the gasification of the carbon components present in the heterogeneous mixture is carried out with the aid of more or less pure oxygen. This, in a known process as disclosed in U.S. Pat. No. 5,282,931, according to DE-OS 4,130,416, the rubbish is compressed into packets which are pre-heated before being fed into a high temperature reactor. Specifically, the rubbish is first compressed, thermally pre-treated in this state with the exclusion of air, and the carbon thus obtained with the aid of oxygen is then gasified. Metallic components in the rubbish can be melted out, nonmetallic components can mineralized to prevent leaching.

The waste material to be prepared according to this process is however stored in a rubbish bunker in the presence of oxygen prior to compression. The possibility of combustion occurring in this rubbish bunker, for example, by dragging in glowing ashes or, the like, cannot be prevented in this situation.

The oxygen required by the known process in the high-temperature stage, is obtained by air decomposition. The nitrogen thereby occurs as a waste product. The nitrogen required for the inert-gas atmosphere in the storage bunker occurs here in a directly usable form. The inert-gas, impacting of the rubbish with this nitrogen thus produces no supplementary costs; rather, it considerably reduces investment and operating costs. In a likewise favorable manner, the carbon dioxide component can also be employed as an inert-gas atmosphere, to the extent it can be utilized for this purpose in the waste treatment plant.

Moreover, the exhaust gases, after thermal utilization of the synthesis gases, contain carbon dioxide which can be separated by conventional methods and used as inert gas for the storage of rubbish, that is, for generation of the inert atmosphere. The heat from the waste treatment system can be used for carbon dioxide separation.

If synthesis gas is generated in a thermal treatment of rubbish according to the process cited above, it can contain up to 30% of carbon dioxide which is then separated and employed as inert gas for the storage of rubbish in this inert atmosphere. Here, too, the heat from the plant itself can be employed advantageously for carbon dioxide separation.

An application of the invented process is also possible in conventional plants of any other type, because the flue gases of these rubbish-incineration plants contain carbon dioxide which is separated with standard methods and can be used as inert gas for the long-term storage of the wastes in an inert atmosphere, in which case the system heat can also be employed for carbon dioxide separation.

Carbon dioxide as the inert gas has the additional advantage that the inert gas extracted from the bunker, from the high-temperature zone, is fed to a thermal treatment plant, decontaminated there and can be optionally included in the gasification process. Extraction of the inert gas from the bunker is through an outlet means of the various types well known in the art.

It is in any case advantageous, if the inert-gas atmosphere is monitored for residual gas components, particularly for oxygen residues and methane fractions. Such monitoring is desirable not only in the actual bunker zone, but also in that of the pressure locks.

Fire-safe storage of heterogeneous rubbish in an inert gas is to take place inside a container sealed off from the outer world. It is also possible for a plant operated independently of the preparation and/or the processing of the waste to use this storage method.

The invented process guarantees the greatest possible availability of the plant in question with correspondingly improved disposal safety. Because it is possible to eliminate active and passive measures for fire protection, significant cost savings can be achieved. Due to the absence A rubbish bunker 10 having a bottom 14 contains heterogeneous rubbish made up of various bulk waste materials 12, as shown in FIG. 1. An inert gas from a supply or source 26 enters the bunker 10 via a conical inlet 16 at the perforated bottom 14 of the bunker 10. A valve 17 controls the flow of inert gas into tile bottom 14 of the bunker 10. This storage inert gas passes through the heterogeneous waste 12 removing and replacing the undesirable combustible gases with a storage inert gas which prevents combustion from occurring in the rubbish bunker 10. The waste 12 is loaded and unloaded through locks or compartments 19 and 20 which are next-adjacent to the bunker 10. The bunker 10 has openings which are opened and closed by doors 21 which are raised and lowered and which are pneumatically sealed when closed to prevent gases from entering or leaving the bunker 10 around the doors 21 therein. Although one lock may be used for both loading and unloading, the embodiment illustrated utilizes two locks 19 and 20, the first 19 for loading the bunker 10 and the second 20 for unloading tile bunker 10.

As the storage inert gas passes through the waste 12, the undesirable and/or used gases contained within the waste 12 are extracted via an outlet line 18 and stored in a storage container 28. Alternatively, these extracted gases can be properly vented to the external atmosphere. Optionally, the storage inert gas can be extracted from the bunker 10, via the outlet 18, and fed to a thermal gasification station or plant 22, via the storage tank 28 and line 29, or directly, where it cain be used in subsequent waste treatment processes.

Minimal amounts of storage inert gas are lost by using the discharge locks 19 and 20 when either of the doors 21 is open. However, the gas atmosphere in the bunker 10 and in the discharge locks 19 and 20 is monitored with monitoring devices 24 to ensure that proper levels of inert gas are maintained a valve 25 controls the extraction of storage inert gas from the bunker 10 by a pump 27 in the line 18. Also, a pressure gage 23 measures the pressure in the bunker 10 and sends a signal to the source of inert gas 26 to supply the predetermined amount or pressure of inert gas into the bunker 10.

Preferably, the thermal gasification station 22 is spaced from the bunker 10. The rubbish 12 is loaded from the first lock 19 by a robot 15 in the first lock 19 through the opening controlled by the first door 21 between the first or loading lock 19 and the bunker 10. The rubbish 12 is unloaded from the bunker 10 to the second or unloading lock 20 by a robot arm 30 in the bunker 10, the door 21 being open during such a transfer. Thereafter, the rubbish 12 is moved by another robot arm 34 in the lock 20 through a doorway controlled by a door 36 arid through a doorway controlled by a door 38 from the second lock 20 and into the thermal gasification station 22. The rubbish is gasified in the thermal gasification station 22 into various gases including a by-product inert gas, such as carbon dioxide. All of the robots 15, 30 and 34 have pick-up fingers 32 for scooping or grasping the rubbish 12.

The by-product inert gas from the thermal gasification station 22 can be conveyed through a line 40 controlled by a valve 42 back to the source 26 and hence to the to the bottom of the bunker for use as the storage inert gas. Alternatively, the inert gas can be supplied to the source 26 from an independent source.

Accordingly, the invention provides a method for storing heterogeneous rubbish 12 made up of various bulk waste materials in a closed rubbish bunker 10 having a bottom 14 and at least one opening 21 which may be opened and closed. The method comprises the steps of loading 15, storing 10 and unloading 34 rubbish into and out of the bunker 10. Inherent in the method is the closing and sealing the opening while storing rubbish 12 in the bunker 10. Also included is the step of introducing a storage inert gas into the bottom 14 of the bunker 10 for flowing the storage inert gas upwardly through the stored rubbish 12 to prevent combustion of the rubbish 12. All the while, the method continuously controls the flow of storage inert gas through the rubbish 12 while the opening 21 is open for replacing the storage inert gas lost through the opening during loading and unloading of the rubbish to continually prevent combustion of the rubbish in the bunker. The storage inert gas is extracted from the bunker 10 through the line 18 for a continuous flow of storage inert gas through the stored rubbish 12.

The method also includes the step of thermally gasifying the rubbish 12 in a thermal gasification station 22 spaced from the bunker 10 and moving the rubbish 12 unloaded from the bunker to the thermal gasification station 22 for thermally gasifying the rubbish into various gases including a by-product inert gas. The by-product inert gas, e.g., carbon dioxide, from the thermal gasification station 22 is conveyed through the line 40 and valve 42 to the supply 26 and to the bottom 14 of the bunker 10 for use as the storage inert gas. Preferably, either one of carbon dioxide and/or nitrogen is used as the storage inert gas.

As alluded to above, the pressure of the storage inert gas in the bunker 10 is maintained at a pressure different than atmosphere pressure surrounding the bunker, preferably at a lower pressure than atmosphere pressure surrounding the bunker. In addition, a monitor 26 monitors the inside of the bunker for gases which would support combustion of the rubbish and sends a signal to the supply 26 for increases the flow of inert gas into the bunker 10.

The invention has been described in an illustrative manner, and it is to be understood that the terminology which has been used is intended to be descriptive rather than limiting.

Obviously, many modifications and variations of the present invention are possible in light of the above teachings. It is, therefore, to be understood that within the scope of the appended claims, the invention may be practiced otherwise than as specifically described.

What is claimed is:

1. A method for storing heterogeneous rubbish made up of various bulk waste materials in a closed rubbish bunker having a bottom and at least one opening which may be opened and closed, said method comprising the steps of:

loading, storing and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish; and continuously controlling the flow of storage inert gas through the rubbish while the opening is open for replacing the storage inert gas lost through the opening during loading and unloading of the rubbish to continually prevent combustion of the rubbish in the bunker.

2. The method as set forth in claim 1 including maintaining the pressure of the storage inert gas at a pressure different than atmosphere pressure surrounding the bunker.

3. The method as set forth in claim 1 further defined as using one of carbon dioxide and nitrogen as the storage inert gas.

4. The method as set forth in claim 1 including monitoring the inside of the bunker for gases which would support combustion of the rubbish.

5. A method comprising the steps of:

storing heterogeneous rubbish made up of various bulk waste materials in a closed rubbish bunker having a bottom and at least one opening which may be opened and closed;

loading and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish;

continuously controlling the flow of storage inert gas through the rubbish while the opening is open for replacing the storage inert gas lost through the opening during loading and unloading of the rubbish to continually prevent combustion of the rubbish in the bunker;

thermally gasifying the rubbish in a thermal gasification station spaced from the bunker and moving the rubbish unloaded from the bunker to the thermal gasification station for thermally gasifying the rubbish into various gases including a by-product inert gas.

6. A method comprising the steps of:

storing heterogeneous rubbish made up of various bulk waste materials in a closed rubbish bunker having a bottom and at least one opening which may be opened and closed, loading and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish;

continuously controlling the flow of storage inert gas through the rubbish while the opening is open for replacing the storage inert gas lost through the opening during loading and unloading of the rubbish to continually prevent combustion of the rubbish in the bunker;

thermally gasifying the rubbish in a thermal gasification station spaced from the bunker and moving the rubbish unloaded from the bunker to the thermal gasification station for thermally gasifying the rubbish into various gases including a by-product inert gas, and conveying the by-product inert gas from the thermal gasification station to the bottom of the bunker for use as the storage inert gas.

7. A method comprising the steps of:

storing heterogeneous rubbish made up of various bulk waste materials in a closed rubbish bunker having a bottom and at least one opening which may be opened and closed, loading and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish;

continuously controlling the flow of storage inert gas through the rubbish while the opening is open for replacing the storage inert gas lost through the opening during loading and unloading of the rubbish to continually prevent combustion of the rubbish in the bunker;

thermally gasifying the rubbish in a thermal gasification station spaced from the bunker and moving the rubbish unloaded from the bunker to the thermal gasification station for thermally gasifying the rubbish into various gases including a by-product inert gas, and extracting the storage inert gas from the bunker for a continuous flow of storage inert gas through the rubbish.

8. A method comprising the steps of:

storing heterogeneous rubbish made up of various bulk waste materials in a closed rubbish bunker having a bottom and at least one opening which may be opened and closed, loading and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish;

continuously controlling the flow of storage inert gas through the rubbish while the opening is open for replacing the storage inert gas lost through the opening during loading and unloading of the rubbish to continually prevent combustion of the rubbish in the bunker;

thermally gasifying the rubbish in a thermal gasification station spaced from the bunker and moving the rubbish unloaded from the bunker to the thermal gasification station for thermally gasifying the rubbish into various gases including a by-product inert gas, and extracting the storage inert gas from the bunker for a continuous flow of storage inert gas through the rubbish and conveying the extracted storage inert gas to the thermal gasification station.

9. A method comprising the steps of:

storing heterogeneous rubbish made up of various bulk waste materials in a closed rubbish bunker having a bottom and at least one opening which may be opened and closed, loading and unloading the heterogeneous rubbish into and out of the bunker;

closing and sealing the opening while storing the rubbish in the bunker;

introducing a storage inert gas into the bottom of the bunker for flowing the storage inert gas upwardly through the stored rubbish to prevent combustion of the rubbish;

continuously controlling the flow of storage inert gas through the rubbish while the opening is open for replacing the storage inert gas lost through the opening during loading and unloading of the rubbish to continually prevent combustion of the rubbish in the bunker;

thermally gasifying the rubbish in a thermal gasification station spaced from the bunker and moving the rubbish unloaded from the bunker to the thermal gasification station for thermally gasifying the rubbish into various gases including a by-product inert gas, and maintaining the pressure of the storage inert gas at a pressure different than atmosphere pressure surrounding the bunker;

maintaining the pressure of the storage inert gas at a lower pressure than atmosphere pressure surrounding the bunker.

10. A method for thermal treatment of heterogeneous rubbish made up of various bulk waste materials in a closed rubbish bunker having a bottom and at least one opening which may be opened and closed, said method comprising the steps of:

loading the heterogeneous rubbish into the bunker;

storing the rubbish in the bunker;

closing and sealing the opening while storing the rubbish in the bunker;

introducing a storage inert gas into the bottom of the bunker for flowing the storage inert gas upwardly through the stored rubbish to prevent combustion of the rubbish;

unloading the rubbish out of the bunker;

continuously controlling the flow of storage inert gas through the rubbish while unloading for replacing the storage inert gas lost through the opening during loading and unloading of the rubbish to continually prevent combustion of the rubbish in the bunker; and thermally gasifying the rubbish in a thermal gasification station spaced from the bunker;

moving the rubbish unloaded from the bunker to the thermal gasification station for thermally gasifying the rubbish into various gases.

* * * * *